US007066058B2

(12) United States Patent
Hsien

(10) Patent No.: US 7,066,058 B2
(45) Date of Patent: Jun. 27, 2006

(54) SPANNER WITH SLEEVE HAVING TEETH AND SMOOTH PORTION

(76) Inventor: Chin-Ching Hsien, 235 Chung-Ho Box 8-24, Taichung Hsien (TW)

( * ) Notice: Subject to any disclaimer, the term of this patent is extended or adjusted under 35 U.S.C. 154(b) by 31 days.

(21) Appl. No.: 10/831,486

(22) Filed: Apr. 26, 2004

(65) Prior Publication Data

US 2005/0235784 A1 Oct. 27, 2005

(51) Int. Cl.
*B25B 13/00* (2006.01)
*B25B 13/02* (2006.01)
*B25B 13/06* (2006.01)

(52) U.S. Cl. ..... 81/124.3; 81/124.1; 81/121.1

(58) Field of Classification Search ..... 81/124.3, 81/124.1, 121.1
See application file for complete search history.

(56) References Cited

U.S. PATENT DOCUMENTS 108,330 A * 10/1870 Cass ..... 81/185
1,273,546 A * 7/1918 Sharp ..... 279/9.1
4,535,657 A * 8/1985 Farris ..... 81/124.1
5,332,272 A * 7/1994 Prince ..... 294/97
6,860,176 B1 * 3/2005 Hsien ..... 81/124.1

* cited by examiner

*Primary Examiner*—George Nguyen
*Assistant Examiner*—Bryan Muller

(57) ABSTRACT

A spanner with a sleeve having teeth and a smooth portion comprises a spanner body having a sleeve at one end thereof. A lower portion of the sleeve is formed with a resisting portion at a lower end. The resisting portion has a plurality of teeth at an inner periphery thereof. An inner wall of the sleeve below the resisting portion is formed as a smooth portion. An upper side of the sleeve is formed as a retracting portion. An annular recess being formed at a retracting portion; a restoring structure including a C ring, a spring, and a push unit. When the buckling flange of the push unit resists against one end of the resisting portion, the resisting surface of the push unit protrudes out of the resisting portion to slightly protrude from the smooth portion.

1 Claim, 4 Drawing Sheets

SPANNER WITH SLEEVE HAVING TEETH AND SMOOTH PORTION

FIELD OF THE INVENTION

The present invention relates to spanners, and particular to a spanner with a sleeve having teeth and a smooth portion.

BACKGROUND OF THE INVENTION

In the prior art, the flower type spanner has a sleeve at a head section thereof for receiving and driving a hexagonal screw element. Then a driving force is applied to lock and attach the screw element to an object.

In the prior art operation of the flower type spanner, tile spanner is operated reciprocally. In locking or releasing the screw element, obstacles are often on the edge of the screw element. Thereby, the user must take out the screw element to remove the obstacles, and then insert the screw element into the spanner, the operation is inconvenient. Moreover, the operations must be performed repeatedly so that the processes become complicated. Further, if the working space is too narrow, the user cannot operate it conveniently. To improve above mentioned defects, type spanner is developed, but the spanner has too many elements so that the cost is high and assembled work is tedious.

Therefore, there is an eager demand for a novel flower type spanner which has the advantages of spanners.

SUMMARY OF THE INVENTION

Accordingly, the primary object of the present invention is to provide a spanner with a sleeve having teeth and a smooth portion which comprises a spanner body having a sleeve at one end thereof. A lower portion of the sleeve is formed with a resisting portion at a lower end; the resisting portion has a plurality of teeth at an inner periphery thereof. An inner wall of the sleeve below the resisting portion is formed as a smooth portion. An upper side of the sleeve is formed as a retracting portion. An annular recess is formed at a retracting portion; a restoring structure including a C ring, a spring, and a push unit. When the buckling flange of the push unit resists against one end of the resisting portion, the resisting surface of the push unit protrudes out of the resisting portion to slightly protrude from the smooth portion.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to allow those skilled in the art to understand the objects, features, and characteristics of the present invention, but not to be used to confine the scope and spirit of the present invention defined in the appended claims.

Figure 1:
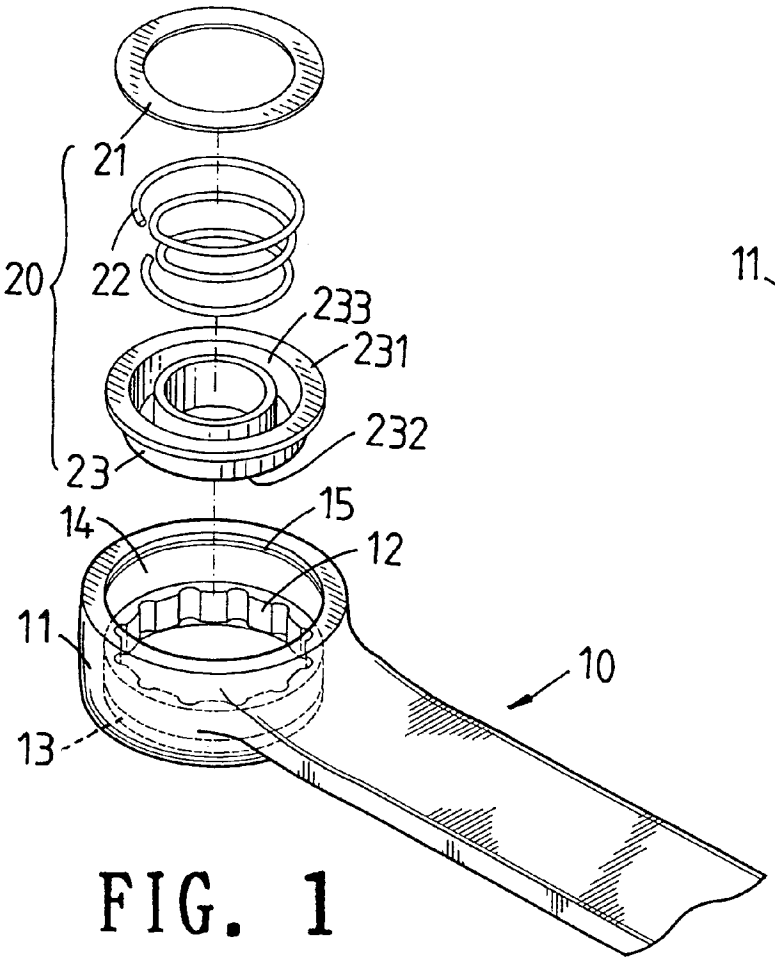
FIG. 1 is an exploded perspective view of the structure of the present invention.

With reference to FIG. 1, the structure of the present invention is illustrated.

A spanner body 10 has a sleeve 11 at one end thereof. A lower portion of the sleeve 11 is formed with a resisting portion 12 at a lower end. The resisting portion 12 has a plurality of teeth at an inner periphery thereof.

An inner wall of the sleeve 11 below the resisting portion 12 is formed as a smooth portion 13. A diameter of the smooth portion 13 is slightly larger than that of the resisting portion 12. Moreover, the diameter of the smooth portion 13 is slightly larger than that of a screw element 30. Thereby, when a screw element 30 is received in a smooth portion 13, the screw element 30 can retract out. An upper side of the sleeve 11 is formed as a retracting portion 14. A diameter of tile retracting portion 14 is slightly larger than that of the resisting portion 12. An annular recess 15 is formed at a retracting portion 14.

A restoring structure 20 includes a C ring 21, a spring 22, and a push unit 23. The push unit 23 is formed as an approximate round disk with a receiving space 233 therein. An upper side of the push unit 23 is formed with a buckling flange 231 and a lower side thereof is formed with a resisting surface 232. A diameter of the buckling flange 231 is slightly smaller than that of the retracting portion 14 and slightly larger than that of the push unit 23. Outer portions of the push unit 23 have sizes smaller than the diameter of the resisting portion 12. Thereby, when the buckling flange 231 of the push unit 23 resists against one end of the resisting portion 12, the resisting surface 232 of the push unit 23 protrudes out of the resisting portion 12 to slightly protrude from the smooth portion 13.

Figure 2:
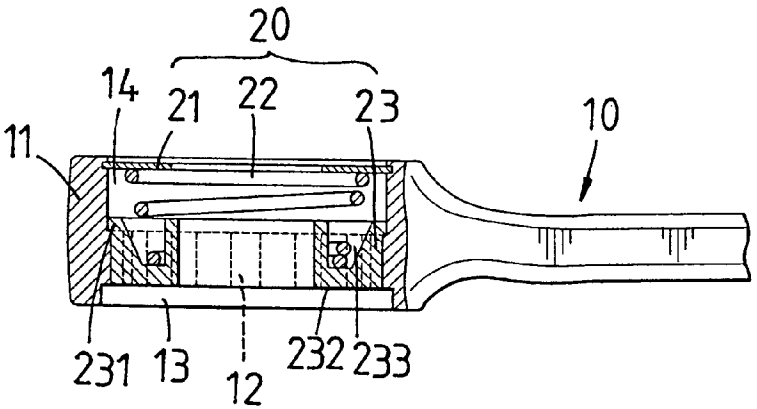
FIG. 2 is a partial cross section view about the hand tool of the present invention.
Figure 4:
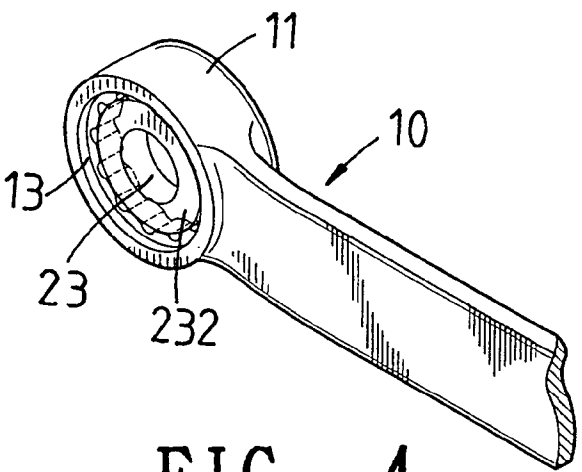
FIG. 4 is a schematic perspective view of the hand tool of the present invention.
Figure 3:
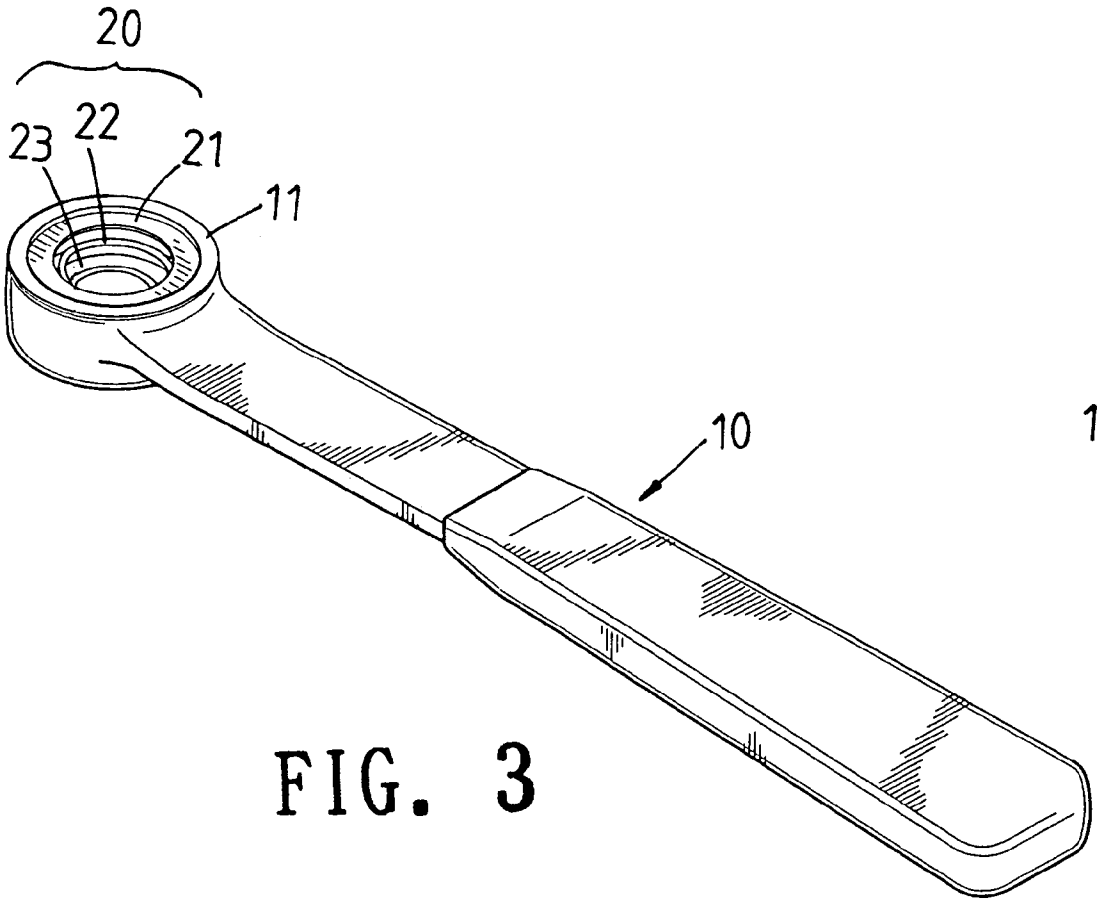
FIG. 3 is a schematic view about the hand tool of the present invention.
Figure 6:
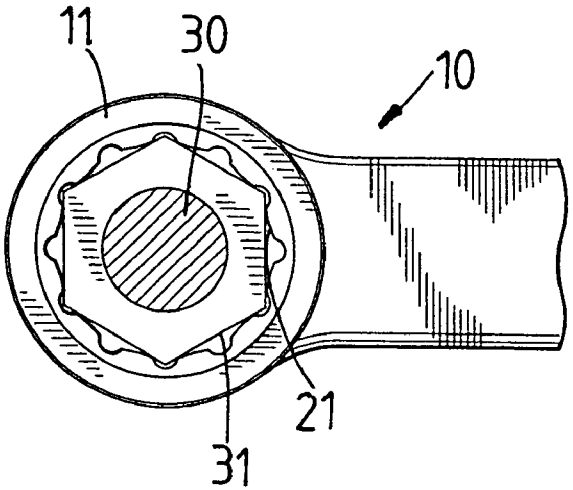
FIG. 6 is an elevational view of the hand tool of the present invention.
Figure 5:
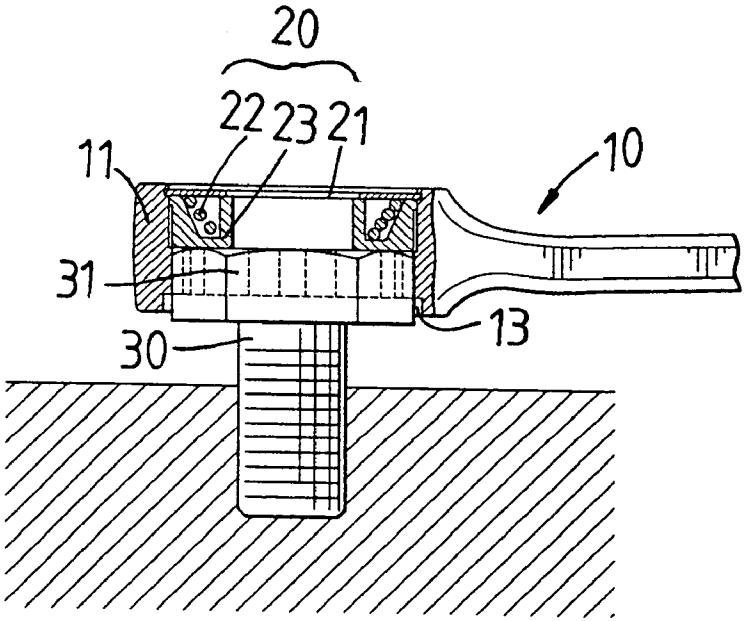
FIG. 5 is a cross section view showing the operation of the hand tool of the present invention.
Figure 7:
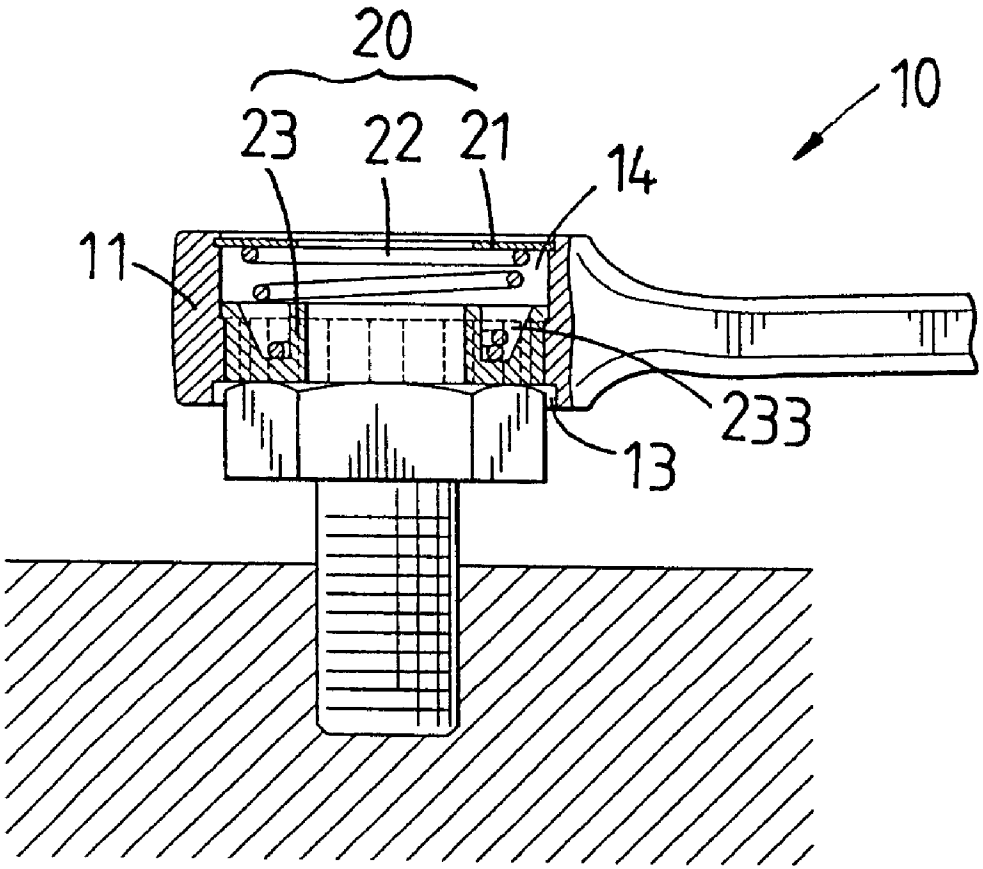
FIG. 7 is a schematic view showing another operation of the present invention.

Referring to FIGS. 2 to 4, in assembly of the present invention, the push unit 23 is received into the retracting portion 14 of the sleeve 11 so that the buckling flange 231 of the push unit 23 resists against one end of the resisting portion 12, while the resisting surface 232 of the push unit 23 slightly protrudes from the smooth portion 13. Then, the spring 22 is installed into the sleeve 11 from the retracting portion 14, while a small section at a front end of the a spring 22 resists against the receiving space 233 of the push unit 23. Finally, the C ring 21 is received in the annular recess 15 of the retracting portion 14 and the push unit 23 and the a spring 22 are confined by the retracting portion 14.

In use of the present invention, when it is desired to release the screw element 30, the sleeve 11 of the spanner body 10 serves to receive the screw element 30. Then a downward force is applied, while the force is larger than the resilient force of the spring 22 in the restoring structure 20. The spring 22 will completely reduce into the receiving space 233 of the push unit 23. The push unit 23 originally pressing downward by the a spring 22 will reduce upwards to be within the retracting portion 14. Moreover, the hexagonal connecting portion 31 of the screw element 30 will resist against the resisting portion 12 at an inner surface of the sleeve 11. Thereby, the screw element 30 can be driven to rotate by the sleeve 11. The user only needs to release the downward pressing force and by the resilient force of the a spring 22 in the restoring structure 20, the spanner body 10 will move upwards so that the hexagonal connecting portion 31 of the screw element 30 originally buckled with the push unit 23 is received in the smooth portion 13 of the screw element 30. Since the smooth portion 13 has no teeth and has the diameter slightly larger than that of the hexagonal connecting portion 31 of the screw element 30, the spanner body 10 will rotate idly so as to achieve the effect of reverse rotation. When the spanner body 10 rotates reversely and restores, a pressing force is applied so that the hexagonal connecting portion 31 of the screw element 30 resists against the resisting portion 12 at the inner surface of the sleeve 11. Then, the screw element 30 can be driven further. Thereby, by using the smooth portion 13, the sleeve 11 can restore rapidly without the defects of the prior art, such as the prior art can not be used in a narrow space or the restoring process of the sleeve needs too much working time.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spanner with a sleeve having teeth and a smooth portion comprising:

a spanner body having a sleeve at one end thereof; a lower portion of the sleeve being formed with a resisting portion at a lower end; the resisting portion having a plurality of teeth at an inner periphery thereof;

an inner wall of the sleeve below the resisting portion being formed as a smooth portion; a diameter of the smooth portion being slightly larger than that of the resisting portion, the diameter of the smooth portion being slightly larger than that of a screw element; thereby, when the screw element is received in the smooth portion, the screw element can retract out of the sleeve; an upper side of the sleeve being formed as a retracting portion; a diameter of the retracting portion being slightly larger than that of the resisting portion; an annular recess being formed at the retracting portion;

a restoring structure including an O ring, a spring, and a push unit; the push unit being formed as an approximate round disk with a receiving space therein and the receiving space having an inclined surface at an outer side thereof; an upper side of the push unit being formed with a buckling flange and a lower side thereof being formed with a resisting surface so as to seal a lower end of the receiving space; a diameter of the buckling flange being slightly smaller than that of the retracting portion and slightly larger than that of the push unit; other portions of the push unit having sizes smaller than the diameter of the resisting portion; wherein in assembly, a part of the O ring is received in the annular recess of the retracting portion;

wherein, when the buckling flange of the push unit resists against one end of the resisting portion, the resisting surface of the push unit protrudes out of the resisting portion to slightly protrude from the smooth portion.

* * * * *